United States Patent [19]

Hardman

[11] 4,351,508

[45] Sep. 28, 1982

[54] REUSABLE PLUGGING DAM FOR BOWLING BALLS

[76] Inventor: Charles A. Hardman, 3326 W. 8th, Lawrence, Kans. 66044

[21] Appl. No.: 83,214

[22] Filed: Oct. 9, 1979

[51] Int. Cl.[3] ..... B22D 19/04

[52] U.S. Cl. ..... 249/90; 249/83; 264/36; 425/DIG. 60

[58] Field of Search ..... 249/90, 83; 425/DIG. 60; 248/363, 206 R; 264/36

[56] References Cited

U.S. PATENT DOCUMENTS

| | | | |
|---|---|---|---|
| 2,259,281 | 10/1941 | Williams et al. | 249/83 |
| 2,875,552 | 3/1959 | Stillman | 248/363 |
| 3,454,440 | 7/1969 | Vezirakis | 249/90 |
| 3,858,839 | 1/1975 | Bowman | 249/90 |
| 3,888,454 | 6/1975 | Treadaway | 249/90 |
| 3,964,726 | 6/1976 | Ott et al. | 249/90 |
| 4,061,872 | 12/1977 | DeMonsy et al. | 249/90 |
| 4,191,357 | 3/1980 | Nesbitt | 249/83 |

*Primary Examiner*—James H. Derrington
*Attorney, Agent, or Firm*—Litman, Day and McMahon

[57] ABSTRACT

A reusable plugging dam for bowling balls is provided for retaining suitable filling compound until set or hard in and somewhat above a finger hole of the ball to be filled such that sufficient filling compound is present to allow for shrinkage during curing or hardening, and be ground and polished to conform to the spherical shape of the ball. The dam includes a body and a suction structure for securing the body to the ball and prevent seepage of the filling compound between the ball and the dam. The body has a port therethrough so as to allow filling of the finger hole with filling compound. Dams are provided for single or multiple finger holes. In addition a dam is provided for use in conjunction with another dam and in particular for filling horizontally aligned holes, this dam having a cover to retain the filling compound in the dam.

9 Claims, 10 Drawing Figures

Fig. 1.
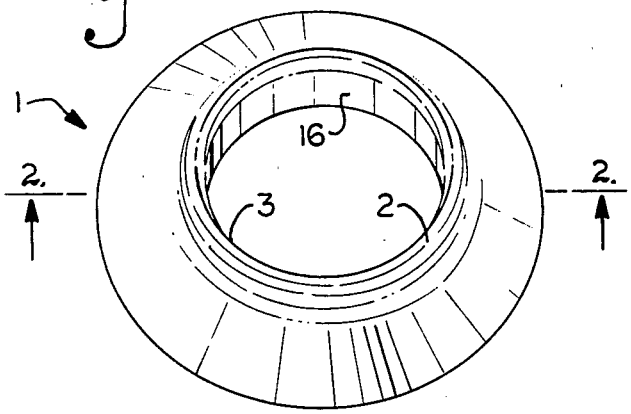
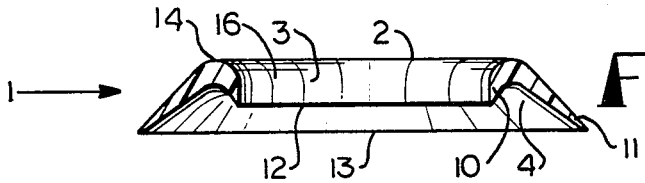
Fig. 2.
Fig. 3.
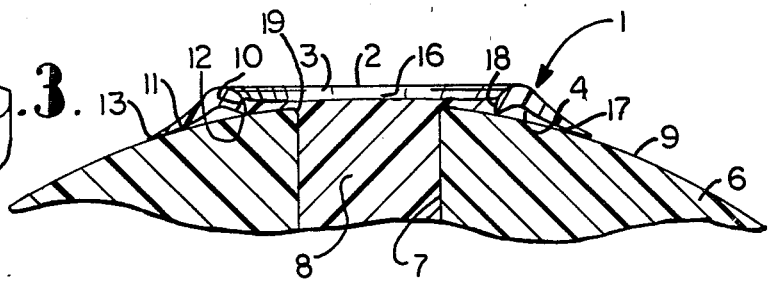
Fig. 4.
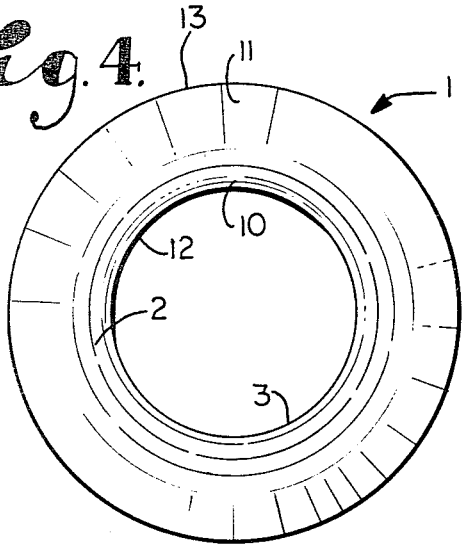
Fig. 5.
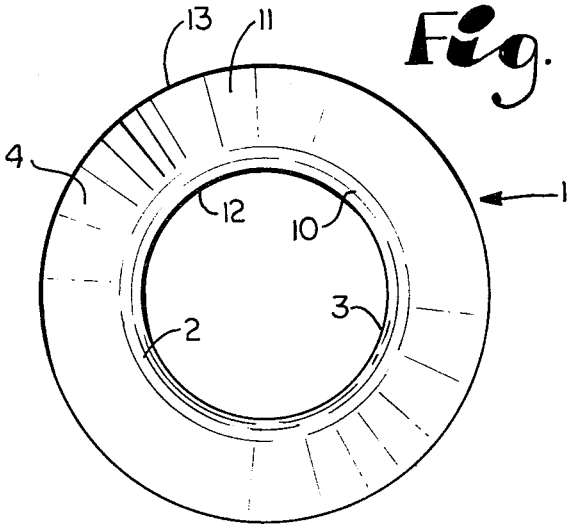

Fig. 8.
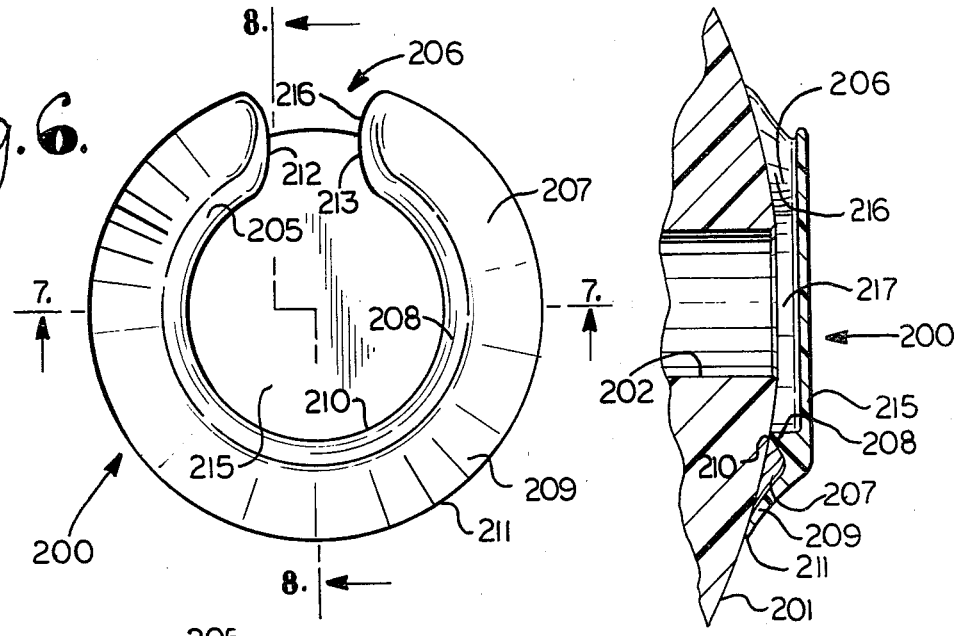
Fig. 6.
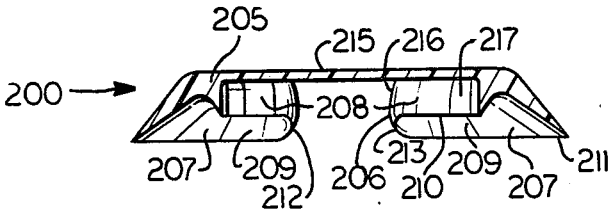
Fig. 7.
Fig. 9.
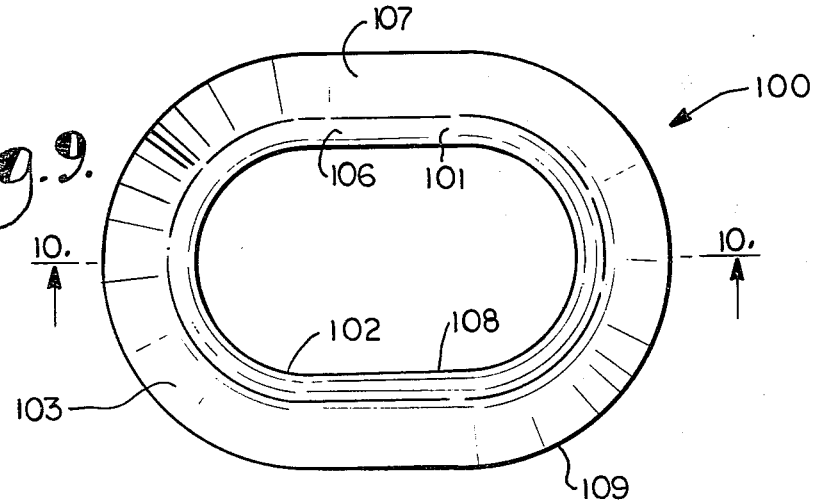
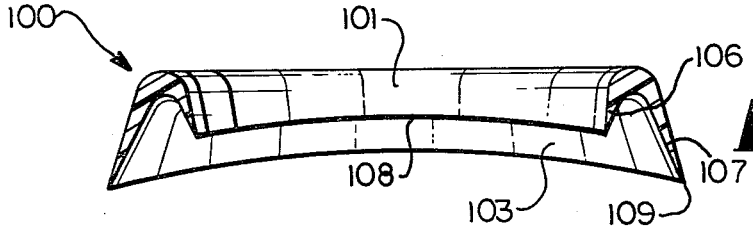
Fig. 10.

REUSABLE PLUGGING DAM FOR BOWLING BALLS

BACKGROUND OF THE INVENTION

The present invention relates to devices for facilitating the filling of finger holes in bowling balls with a suitable liquid or semi-liquid filling compound, in particular to such devices whereby the filling compound can be poured above the level of the finger hole so the excess filling compound provides for shrinkage during curing or hardening with the cured or set filling compound extending at least to the outer arc of the ball.

In the sport of bowling it is often advantageous or desirable to change the location or size of one or all of the finger holes. For instance the ball may be sold to a new party or the owner may wish to change the configuration of the finger holes. The task of changing size or location of the holes is most easily accomplished by filling in the old holes with a compatible filling compound, such as epoxy or the like, and drilling new holes.

Several problems are encountered in filling the holes. In particular, the filling compound must extend above the top of the hole so as to provide for shrinkage and so as to conform to the arc of the ball. Thus some device must be utilized to hold the filling compound in place over the hole until set. Another problem is that the filling compound is relatively expensive and thus it is desirous to minimize excess usage thereof. Further, the excess set filling compound must be removed from the ball by a grinding and polishing process or the like which process is easier to accomplish when the surface to be ground is minimal and there is very little excess filling compound. Thus, it is important to keep the filling compound from seeping, oozing, or overflowing the dam onto the ball. It is also important to be able to fill more than one finger hole at the same time since curing time of the filling compound is relatively long and it is more efficient to fill all the holes to be plugged at the same time.

One widely used device for holding the filling compound has been clay which is hand molded into a barrier about the hole and chopped away after use. The major problem related to clay barriers is that utilization thereof tends to be very labor intensive and time consuming, and there is very little consistency of size or shape associated therewith. Thus, preferably a dam should be easy to use, consistant in shape, available in standardized sizes, and reusable.

Other types of conventional dams include somewhat inflexible devices of materials, such as polystyrene marketed under the trademark Styrofoam by the Dow Chemical Co., which surround a hole to be filled and are held thereabout by an adhesive applied to the ball and/or the dam. The major problems associated with such adhered devices are that there is a tendency of the filling compound to seep between the base thereof and the ball and for the most part they are not reusable.

OBJECTS OF THE INVENTION

Therefore, the objects of the present invention are: to provide a dam for retaining filling compound in place above the hole of a bowling ball until such compound is set; to provide such a dam which prevents seepage or oozing of the filling compound onto the ball; to provide such a dam which is reusable; to provide such a dam which can be utilized by itself or with similar dams for filling multiple holes simultaneously; to provide such a dam which comprises a pliable body having a port therein communicating with the hole and suction means to easily and removably secure the dam to the ball; to provide such a dam in combination with a bowling ball and utilizing a wetting agent to aid in securing the dam to the ball; to provide a separation or release agent to assist in removing the dam from dried or set filling compound; to provide a method for utilizing such a dam to fill a bowling ball hole; and to provide such a dam which is capable of an extended useful life, relatively inexpensive to produce, and is particularly well adapted for the proposed use therefore.

Other objects and advantages of this invention will become apparent from the following description taken in connection with the accompanying drawings wherein are set forth, by way of illustration and example, certain embodiments of this invention.

SUMMARY OF THE INVENTION

A dam is provided for use in facilitating plugging of finger holes of a bowling ball with a compatible filling compound. The dam comprises a body portion having a port extending therethrough and communicating with the finger hole when the dam is in place upon the ball. The dam includes suction means for maintaining the dam on the ball and preventing seepage of the filling compound between the ball and the dam. Preferably, the suction means comprises a deformable cavity having edges suitable for sealing with the ball. When the dam is placed on the ball and compressed by hand, the cavity deforms, becoming smaller. Upon release of pressure on the dam, the cavity is resiliently urged to return to the original shape thereof but cannot because the edges form an airtight seal. Thus a vacuum is produced which secures the dam to the ball until the vacuum is selectively broken by the user. Multiple hole filling dams are also provided. In addition a modified dam with a cover thereover can be used in conjunction with another dam to fill multiple holes simultaneously, in particular when the axis of one of the holes is horizontally or nearly horizontally disposed.

The drawings consitute a part of this specification and include exemplary embodiments of the present invention and illustrate various objects and features thereof.

BRIEF DESCRIPTION OF THE DRAWINGS

FIG. 1 is a perspective view of a dam embodying the present invention.

FIG. 2 is a cross-sectional view of the dam taken along line 2—2 of FIG. 1.

FIG. 3 is a view similar to FIG. 2, with the dam shown in an operative position around the finger hole of a bowling ball with a filling compound plugging the finger hole.

FIG. 4 is a top plan view of the dam.

FIG. 5 is a bottom plan view of the dam.

FIG. 6 is a bottom plan view of a first alternative embodiment of the dam.

FIG. 7 is a cross-sectional view of the first alternative embodiment of the dam taken along line 7—7 of FIG. 6.

FIG. 8 is a cross-sectional view of the first alternative embodiment of the dam taken along line 8—8 of FIG. 6 with the dam shown in operative position about a finger hole of a bowling ball.

FIG. 9 is a bottom plan view of a second alternative embodiment of the dam.

FIG. 10 is a cross-sectional view of the second alternative embodiment of the dam taken along line 10—10 of FIG. 9.

DETAILED DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates an embodiment of a dam according to the present invention which is illustrated in FIGS. 1 through 5. The dam 1 includes a body 2 having a filling aperture or port 3 therethrough and suction means or a concave suction producing surface 4 thereon.

As used herein, the terms "top," "bottom," "vertical," "horizontal," and common derivatives thereof have the same meanings as shown in the drawings. As used herein the term "Finger Hole" is understood to mean thumb hole also.

As shown in FIG. 3, the dam 1 is utilized in conjunction with a spherical bowling ball 6 having a plurality of finger holes, one of such holes being illustrated as hole 7 with the dam 1 placed thereabout. The finger hole 7 is shown having filling compound 8 therein and immediately thereabove. The ball 6 includes a spherical surface 9. The diameters of most bowling balls, such as ball 6, are substantially equivalent; therefore, the dam should function with most balls.

The dam body 2, of the embodiment of FIGS. 1 through 5, is annularly shaped or ring like with the inner opening therethrough defining the port 3. The radius of the port 3 is preferably at least as large as the finger hole 7 although it is foreseen that the size of the port 3 can be varied depending on the size of the finger hole 7.

Depending from the inner and outer sides of the body 2 are skirts or margins 10 and 11 respectively. Each of the skirts 10 and 11 has a lower distal edge or lip 12 and 13 respectively, the edges or lips 12 and 13 extending in a generally circular or ring shape. The dam 1 has an operational orientation wherein the skirt lips 12 and 13 are positioned on the bowling ball surface 9 with the circular configuration of both skirts lips 12 and 13 conforming to the arc of the ball 6 where engagement takes place. When a vacuum producing a suction is formed between the concave surface 4 and the ball surface 9, the skirt lips 12 and 13 perform the function of seals which prevent air from breaking the suction so formed. The body 2 has an upper edge 14 spaced from both the concave surface 4 and the ball 6 when the dam 1 is in operational orientation thereon. The body 2 in conjunction with the interior skirt 10 has an interior surface 16 which engages the hole filling compound 8. The skirt lip 12 also seals between the body surface 16 and the ball surface 9 such that filling compound will not seep or ooze therebetween.

The dam 1 is constructed of pliable, resilient material with sufficient chemical and heat resistance to withstand heat produced during setting or curing of the filling compound 8. Curing temperatures in the nature of 250° Fahrenheit are common with filling compounds. The dam 1 may also have to withstand the heat of lamps used to speed the curing process of the filling compound 8. A suitable material of construction is thermal plastic rubber. A particularly effective dam 1 may be produced from a styrene-butadiene-styrene block copolomer produced by Shell Oil Co. under the trademark "Kraton" and having a stock number of 3202-2000-7. The dam 1 must be sufficiently hard to form a fixed wall to hold the filling compound in place but pliable enough to form and maintain a vacuum between the concave surface 4 and ball surface 9 without seepage of air or filling compound beneath the skirt lips 12 and 13.

The filling compound 8 may be any conventional composition normally consisting of a resin and a catalyst, such as epoxy or the like which sets, dries, cures, or hardens to form a plug having a consistency very similar or equivalent to the material of construction of the ball 6.

Preferably, a wetting agent, the location of which is signified by the numeral 17, is used on the concave surface 4 to improve the airtight seal of the skirt lips 12 and 13 with the ball surface 9. The wetting agent is preferably rubbing alcohol but may be water, detergent, or any other suitable wetting agent which will not damage the ball 6, dam 1 or filling compound 8.

Further, a separation, parting or release agent, the location of which is signified by the numeral 18, is preferably utilized on the inner surface 16 of the dam body 2. The release agent improves separation of the dam 1 from the set filling compound 8. The release agent may be any of the conventional release agents such as silicone, wax or the like.

In use, the bowling ball 6 is oriented in a manner that the axis of the finger hole to be filled is substantially vertically positioned. The bevel around a mouth 19 of the finger hole can be routed away, and the hole 7 may be enlarged to aid in filling thereof. The dam 1 is placed on the ball 6 so as to be centered relative to the finger hole 7, with the port 3 communicating with the finger hole mouth 19. The wetting agent may optionally be applied on the concave surface 4 just prior to placement of the dam on the ball 6. The palm of the hand or the like is placed over the dam 1 and pressure is applied thereto. The pressure somewhat deforms the dam 1, thus collapsing the body 2 slightly, so as to position the concave surface 4 nearer to the ball surface 9 and reduce the volume of the cavity. The skirts 10 and 11 are sufficiently flexible to allow pressurized air to be expelled from the cavity between the concave surface 4 and ball surface 9 as shown in FIG. 3. The pressure from the hand is then released from the dam 1, and the lips 12 and 13 form seals with the ball surface 9 after which the resilient dam 1 attempts to return to the normal shape thereof, which normal shape is shown in FIG. 2. The skirts 10 and 11 do not fold under the body 2 when same is in place on the ball 6, thus they do not rise and allow air to come back into the cavity once hand pressure is released from the dam 1. Since air is prevented from entering the cavity between the concave surface 4 and ball surface 9 by the skirt lips 12 and 13, vacuum producing a suction is formed in the cavity which fixedly holds the dam 1 to the ball 6. The dam 1 is now in the operational orientation thereof.

The mold release agent optionally is applied to the body interior surface 16. Care should be taken not to get any of the release agent into the finger hole 7 so that same does not interfere with adhesion of the filling compound 8 to the finger hole 7. At times the finger hole 7 may be in the vicinity of an engraving (not shown) on the surface of the ball. If the dam 1 must extend over the engraving, a filling substance such as wax, for example as marketed under the Trademark Chapstick, or the like may be inserted in the engraving to provide better sealing action between the skirt lips 12 and 13 and the ball 6. The filling compound 8, normally a thick liquid or plastic before drying, is poured into and above the hole 7 but not over the top of the dam 1. While the filling compound is in a liquid state, gravity will tend to form a smooth surface thereon over the hole 7 and within the confines of the dam 1. The dam 1 holds the filling compound 8 in place until same is set. The filling compound 8 should extend above the finger hole mouth 19 a sufficient distance to insure that the set or hard filling compound 8 will extend over the finger hole 7 a sufficient distance to at least conform to the spherical surface 9 of the ball 6 projected over the finger hole 7. The filling compound 8 can be expected to shrink some during drying.

The filling compound 8 normally requires 6 to 18 hours for drying. After drying, a blunt instrument or the like is slid beneath the exterior skirt lip 13 and raised so as to allow air into the cavity between the concave surface 4 and ball surface 9 and thereby break the vacuum or suction existing therein. The dam 1 is carefully removed from the ball 6 and from the cured filling compound 8. At this point the dam 1 is reusable and can be utilized to fill a second finger hole. The excess cured filling compound 8 is removed from the ball 6 by suitable grinding, and polishing, or similar procedures to return the ball 6 to a smooth spherical shape. The ball 6 is then ready to have one or more new finger holes drilled therein.

A second embodiment of the dam of the present invention is illustrated in FIGS. 9 and 10 and is generally designated by the numeral 100. The dam 100 is for use in filling multiple finger holes of a bowling ball simultaneously. The dam 100 includes an oval shaped body 101 having a port 102 therethrough and a lower concave surface 103. Depending from the interior and exterior sides of the body 101 are skirts 106 and 107 respectively which have distal edges or lips 108 and 109 respectively. The lips 108 and 109 are positioned so as to follow and seal with the surface of a ball about the interior and exterior respectively of the dam 100.

In use the second embodiment, illustrated in FIGS. 8 and 9, functions substantially as the first embodiment except that two finger holes are filled or plugged simultaneously, thus reducing overall plugging time. In particular, the dam 100 is pressed onto a ball around the finger holes to be filled and a vacuum is formed in the cavity between the concave surface 103 and the ball with the lips 108 and 109 forming an airtight seal, thus, producing a suction and holding the dam 100 in an operative orientation on the ball, while filling compound is poured into the hole to be plugged.

A third embodiment of the dam of the present invention is illustrated in FIGS. 6, 7, and 8 and is generally designated by the numeral 200. The modified dam 200 is utilized for filling additional holes on a bowling ball 201 in conjunction with one of the other embodiments described above, that is dam 1 or dam 100. In particular, the modified dam 200 provides for filling a finger hole 202 when the ball 201 is positioned such that the axis of the hole 202 is at a substantial angle to vertical or horizontally positioned. The dams 1 and 100 would not be suitable for such a function since the filling compound would run or seep over the top of such dams and down the side of the ball.

The dam 200 includes a somewhat horseshoe or crescent shaped body 205 having a port 206 and a suction means or concave surface 207. The port 206 communicates with the finger hole 202 such that the latter may have the filling compound poured therein. Attached to inner and outer portions of the body 205 and depending therefrom are skirts or margins 208 and 209 which have distal lips or edges 210 and 211 respectively. The skirts 208 and 209 are joined at opposite ends of the body 205 by end wall portions 212 and 213. The concave surface 207 extends on the bottom side of the body 205 between the skirt edges 210 and 211 and the end wall portions 212 and 213.

A cover 215 extends over the body 205 on the side thereof opposite the concave surface 207. A first aperture or passage 216 is positioned between and defined by the end wall portions 212 and 213 and the cover 215. A second aperture or chamber 217 is positioned in the center of the dam 200 between walls of the body 205 and the cover 215. The second aperture 217 communicates with the first aperture 216, and together these define the port 206. The first aperture 216 will normally be positioned on the ball 201 above finger hole 202 opening upwardly.

In use the third embodiment, illustrated in FIGS. 6 and 7 and 8, functions substantially as the first embodiment except it is applied to a finger hole 202 having an axis substantially angled with respect to vertical and is most often utilized in conjunction with either the dam 1 or 100 described hereinabove. In particular, the dam 200 is pressed onto the ball 201 around the finger hole 202 thereof to be filled, and a vacuum is formed in the cavity between the concave surface 207 and the ball 201 with the lips 210 and 211 in conjunction with the wall portions 212 and 213 forming an airtight seal, thus producing a suction and holding the dam 200 in an operative position on the ball 201. The dam 200 is applied in a manner so that the aperture 216 is above the finger hole 202 and on the upper side of the dam 200. Filling compound is poured into the aperture 216, through the aperture 217, and into the finger 201, until the filling compound is at least above the level of the finger hole 201. The cover 215 keeps the filling compound from running over the dam 200 onto the ball 201.

It is to be understood that while certain embodiments of the present invention have been illustrated and described herein, it is not to be limited to the specific forms or arrangement of parts described and shown.

Having thus described the invention, what is claimed and desired to secure by Letters Patent is:

1. A dam structure for detachably mounting upon a bowling ball comprising:

(a) a dam body forming an enclosure for extending substantially about a finger hole in a bowling ball for plugging same, said dam body being of resilient material and having inner and outer skirts defining a concave surface;

(b) said inner skirt forming a wall defining a filling port through said dam body;

(c) said inner and outer skirts diverge in sloping relationship and having diverging lower surfaces for sealing engagement with a bowling ball outer surface, said skirts defining a cavity therebetween for providing a partial vacuum chamber with an outer surface of a bowling ball; and (d) said skirts being resiliently deformable downwardly upon manual pressure on said dam body toward said bowling ball to spread said skirts outwardly and at least partially exhaust air in said cavity to engage said dam body upon said bowling ball in self-sealing relationship.

2. The dam as set forth in claim 1 wherein:

(a) said body has an upper surface spaced from said concave surface; said upper surface being spaced a sufficient distance from said bowling ball surface, when said dam is placed thereon, to ensure that when said finger hole is filled with a filling compound, said filling compound overfills said finger hole to a level to provide for shrinkage of said filling compound on hardening and to insure that the hardened filling compound does not shrink inwardly into the finger hole past the surface of the bowling ball.

3. The dam according to claim 1 wherein:

(a) said dam has an operative position wherein said dam is positioned on a bowling ball and secured thereon by said suction means; and (b) said concave surface is bounded by an arcuate inside lip near the finger hole when the dam is in the operative position thereof and an arcuate outside lip; said inside and outside lips adapted for sealing against the surface of the bowling ball when said dam is in the operative position thereof and preventing outside air from entering a cavity between the ball and said concave surface.

4. The dam according to claim 2 wherein:

(a) said body comprises an annulus having an interior passage defining said port;

(b) said port has a diameter at least as large as the finger hole.

5. The dam according to claim 2 wherein:

(a) said body is oval shaped having an interior passage defining said port;

(b) said passage is sufficiently large to enclose at least openings of two finger holes of the ball.

6. The dam according to claim 1 wherein:

(a) said body is crescent shaped and has ends defining a first aperture therebetween; said body including a central second aperture communicating with said first aperture and being adapted for surrounding a ball finger hole; said first and second apertures defining said port;

(b) said dam includes a cover; said cover being attached to said body and extending over said central second aperture on the side of said body opposite said suction means; whereby when said dam is positioned around a finger hole having a non vertically disposed axis with said first aperture on an upper side of the finger hole, said port allowing filling of the non vertical finger hole with filling compound and said cover retaining the filling compound in and about the non vertical finger hole.

7. A dam as set forth in claim 1 in combination with:

(a) a bowling ball having a spherical outer surface and at least one finger hole to be plugged; and wherein (b) said dam has an operational configuration upon said ball such that a suction is formed between said cavity and said ball upon manual deformation of said dam body toward said bowling ball whereby said body is secured to said bowling ball surface.

8. The combination according to claim 7 including:

(a) a wetting agent positioned between said concave surface and said ball; said wetting agent improving the seal of said inner and outer lips with said ball surface.

9. The combination according to claim 7 including:

(a) a release agent positioned on said dam to facilitate separation of a dam from said filling compound after said filling compound hardens.

* * * * *